US005705037A

United States Patent [19]

Reinke et al.

[11] Patent Number: 5,705,037

[45] Date of Patent: Jan. 6, 1998

[54] DEVICE FOR REDUCING THE CONCENTRATION OF CO IN THE WASTE GAS FROM COKE OVEN BATTERIES THAT ARE HEATED WITH LEAN GAS

[75] Inventors: Martin Reinke, Dortmund; Werner Hippe, Gladbeck; Gunter Meyer, Essen; Hans Oldengott, Hamm, all of Germany

[73] Assignee: Krup Koppers GmbH, Germany

[21] Appl. No.: 568,632

[22] Filed: Dec. 7, 1995

[30] Foreign Application Priority Data

Dec. 21, 1994 [DE] Germany ..... 44 45 713.8

[51] Int. Cl.[6] ..... C10B 1/06; C10B 25/06; C10B 25/24

[52] U.S. Cl. ..... 202/248; 202/269; 202/267.1

[58] Field of Search ..... 202/242, 248, 202/269, 267.1; 201/41

[56] References Cited

U.S. PATENT DOCUMENTS

| | | | |
|---|---|---|---|
| 3,963,582 | 6/1976 | Helm et al. | 201/2 |
| 3,969,191 | 7/1976 | Bollenbach | 202/141 |
| 4,033,827 | 7/1977 | White, Jr. | 202/248 |
| 4,256,540 | 3/1981 | Strobel et al. | 202/139 |
| 4,357,211 | 11/1982 | Wackerbarth et al. | 202/111 |
| 4,406,619 | 9/1983 | Oldengott | 432/250 |
| 4,533,439 | 8/1985 | Dickerson et al. | 201/41 |
| 4,749,446 | 6/1988 | van Laar et al. | 202/139 |
| 5,228,955 | 7/1993 | Westbrook, III | 202/93 |

FOREIGN PATENT DOCUMENTS 7724 8/1902 Germany .

*Primary Examiner*—Nina Bhat
*Attorney, Agent, or Firm*—Vickers, Daniels & Young

[57] ABSTRACT

In order to reduce the concentration of CO in the waste gas of coke oven batteries that are heated by lean gas, additional sealing is used for the brick-work of die regenerator separating walls of the coke oven battery, as well as a coke oven battery with a regenerator having brick-built separating walls, between ducts that carry lean gas and waste gas, in which one has arranged stainless steel sheets in front of the regenerator separating wall with, preferably, an intermediate layer that is located behind it that comprises ceramic fibers. In this regard, the stainless steel sheets, that overlap with one another in each case, are preferably held by rod-shaped tensioning device.

25 Claims, 3 Drawing Sheets

DEVICE FOR REDUCING THE CONCENTRATION OF CO IN THE WASTE GAS FROM COKE OVEN BATTERIES THAT ARE HEATED WITH LEAN GAS

The invention relates to the art of reducing waste gas and, more particularly, to a process and a device for reducing the concentration of CO in the waste gas from coke oven batteries that are heated with lean gas.

BACKGROUND OF THE INVENTION

Use is frequently made of so-called lean gas for heating coke oven batteries. The "lean gas" is generally slightly carburetted blast furnace gas that has a CO concentration of about 20% by volume. CO concentrations of between 50 and 200 ppm are expected in the case of a clean combustion installation. In practice, however, it has been found that values of 500 to 2000 ppm of CO arise in the waste gas in many cases even though good adjustment of the combustion conditions took place.

As a consequence of environmental protection injunctions that are becoming ever more stringent and analytical procedures that are becoming ever snore accurate, requirements are being intensified to keep the concentration of CO as low as possible in the waste gas from coke oven batteries.

The task that therefore forms the basis of the invention is to find a suitable solution for this problem.

SUMMARY OF THE INVENTION

In order to solve the problem of reducing the concentration of CO in waste gas from coke oven batteries that are heated with lean gas so as to meet required CO concentration standards set by various environmental laws and regulations, there is provided, in accordance with the preferred embodiment of the invention, a coke oven which includes specially sealed regenerator walls. The regenerator includes brick-work in the regenerator separating walls which brick-work includes a horizontally acting sealing arrangement which seals the regeneration from other chambers in the coke oven.

In accordance with another feature of the present invention, the brick-work of the regenerator includes sheeting comprising a heat-resistant material that is installed in front of the gas-side surfaces of the regenerator separating walls, whereby use is preferably made of an intermediate layer between the sheeting and the regenerator separating wall and whereby the sheeting comprises a compressible temperature-resistant material.

In accordance with yet another feature of the present invention, the additional sealing of the regenerator takes place within the brick-work of the regenerator separating walls.

In accordance with still yet another feature of the present invention, the additional sealing of the regenerator takes place both with sheeting in front of the gas-side surfaces of the regenerator walls and within the brick-work of the regenerator separating walls.

In accordance with another feature of the present invention, the coke oven includes a regenerator heated with lean gas and the regenerator includes brick-built separating walls between ducts that carry lean gas and waste gas. Preferably, at least one of the front of the regenerator separating wall includes stainless steel sheets. Preferably an intermediate layer that is located behind the stainless steel sheets comprises ceramic fibers. The stainless steel sheets, that overlap with one another, are preferably held by rod-shaped tensioning devices.

In accordance with another feature of the present invention, the stainless steel sheets and the intermediate layer are attached at the regenerator separating wall by means of gluing.

In accordance with still another feature of the present invention, the regenerator includes brick-built separating walls between ducts that carry lean gas and waste gas, and the separating walls have vertical joints behind the rectangular bricks of the brick-work of the regenerator separating walls and one wall has arranged gas-tight foils.

In accordance with still yet another feature of the present invention, the regenerator includes brick-built separating walls between ducts that carry lean gas and waste gas and the brick-work of the regenerator separating walls, one wall has arranged vertical ducts that have been filled with a sealing composition.

These and other advantages will become apparent to those skilled in the art upon reading the following description taken together with the accompanying drawings.

BRIEF DESCRIPTION OF THE DRAWINGS

Reference may now be made to the drawings, which illustrate various embodiments that the invention may take in physical form and in certain parts and arrangement of parts wherein.

DETAILED DESCRIPTION OF PREFERRED EMBODIMENTS

Figure 1:
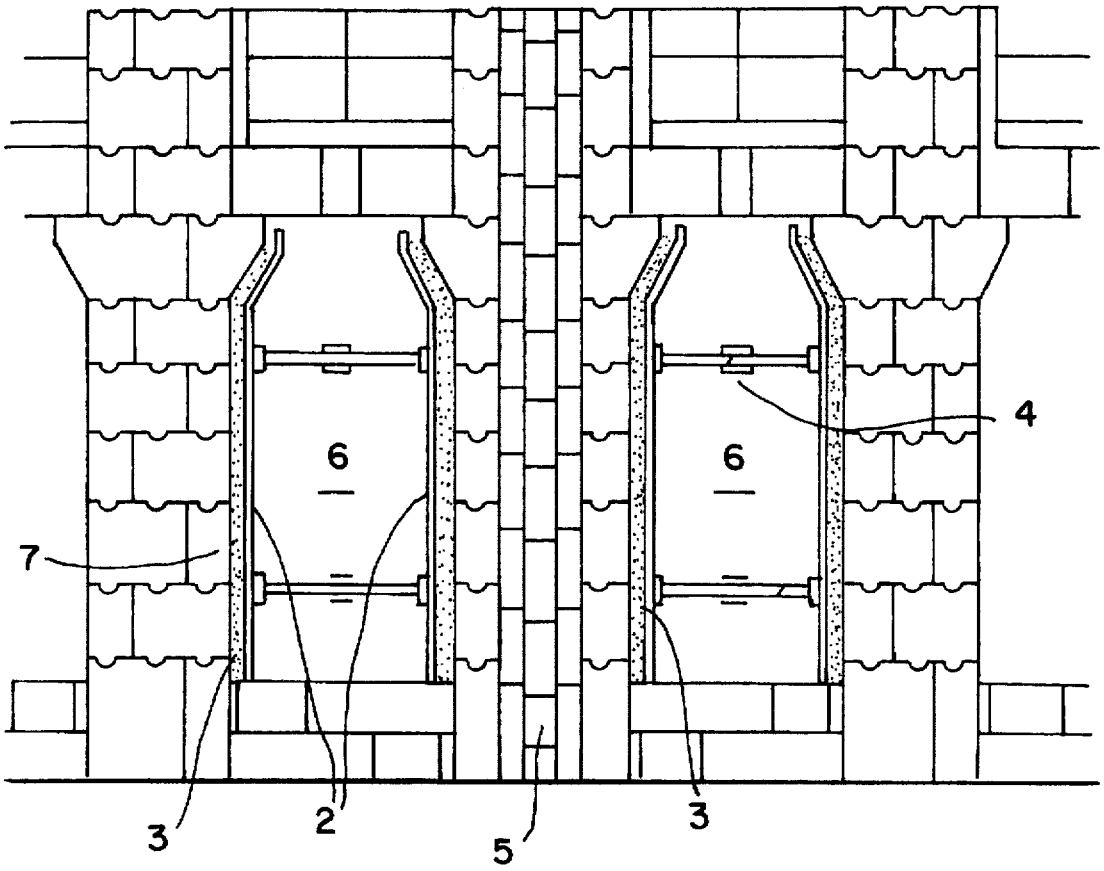
FIG. 1 is a vertical section through the regenerator chambers of a base burner/composite coke oven, whereby the sealing of the chambers takes place at the surfaces of the regenerator separating walls that are contacted by the materials.

Referring now to the drawings, wherein the showings are for the purposes of illustrating the preferred embodiments of the invention only and not for the purpose of limiting the same, the knowledge that forms the basis of the invention in this connection is that the strongly pronounced temperature-dependent expansion and shrinkage of the silica bricks and fire-bricks that are used for the assembly of the regenerator walls can lead to the occurrence of hairline cracks in the mortar joints of the brick-work of the regenerator separating walls and, as a result of these hair-line cracks, the lean gas that flows through the regenerator for the purpose of preheating can, in part, get into adjacent regenerator cells through which the waste combustion gases flow. This migration of gas then leads to a corresponding increase in the concentration of CO in the waste gas.

Undesired migration of lean gas into the duct for waste gas is obviated by sealing off the regenerator separating walls in accordance with the invention. In this connection, the additional sealing off can take place either at or, as the case may be, on the surfaces of the regenerator walls, at are contacted by the materials, by means of sheets that comprise a heat-resistant material, or additional sealing off is carried out within the brick-work of the regenerator separating walls.

In order to seal off the regenerator separating walls, the steps that are described above can also be used in combination with one another.

For the sealing of the separating walls in the case of the form of embodiment in accordance with FIG. 1, one has arranged stainless steel sheets 2 in front of the surfaces of the regenerator separating walls that are contacted by gas. In order to improve the sealing effect still further, an intermediate layer 3, that comprises a sealing material, is also arranged between the stainless steel sheet 2 and the regenerator separating wall 1. For this, use can be made of, for example, compressible temperature-resistant mats comprising ceramic fibers or even fire-resistant compressed compositions. In the present example of an embodiment, stainless steel sheets 2, that overlap with one another in each case, are held in position, together with the intermediate layer 3 that is located below, by the rod-shaped tension devices 4 that, in the opened out state, press the stainless steel sheet 2 onto the regenerator separating walls 1. Basically, however, it is also possible to attach the stainless steel sheets 2 and the intermediate layer 3 to the regenerator separating wall 1 by gluing by means of a temperature-resistant adhesive that is suitable for this purpose. Instead of the stainless steel sheets 2, use can also be made, of course, of any other sheet-like material that is suitable for this purpose. In the case of the example of an embodiment that is illustrated in FIG. 1, one is dealing with a so-called base burner/composite coke oven. In this example of an embodiment, every second regenerator separating wall 1 is provided with a duct 5 for rich gas that runs vertically upward. Each regenerator separating wall separates two adjacent regenerator chambers 6.

Figure 3:
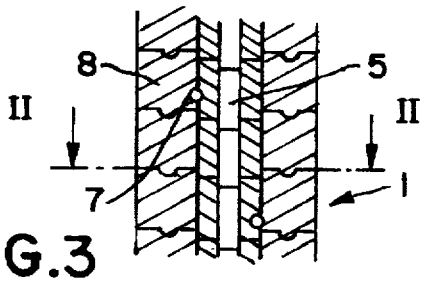
FIG. 3 is a vertical section along the line III—III of FIG. 2.
Figure 5:
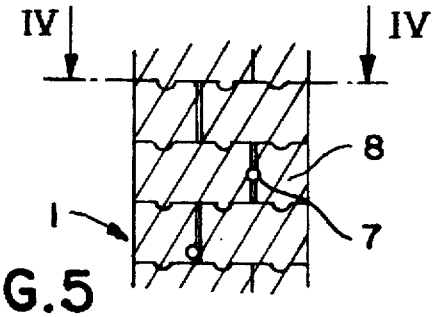
FIG. 5 is a vertical section along the line V—V of FIG. 4.
Figure 2:
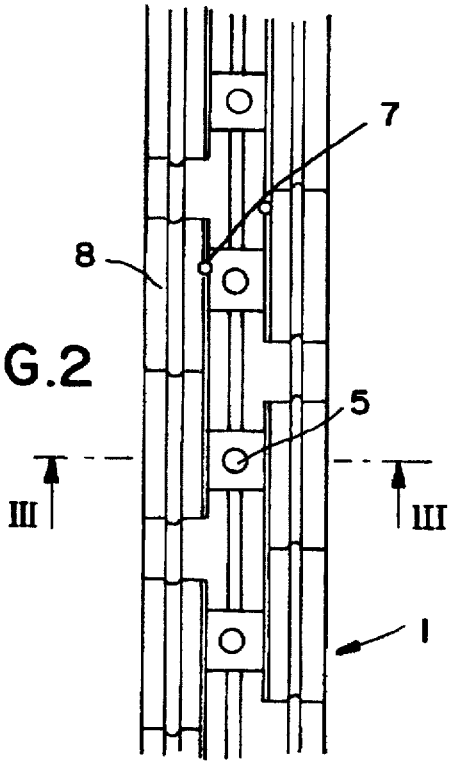
FIG. 2 is a horizontal section through a portion of a regenerator separating wall of a base burner/composite coke oven, whereby the sealing of the chambers takes place by means of gas-tight foils that are arranged in the brick-work.
Figure 4:
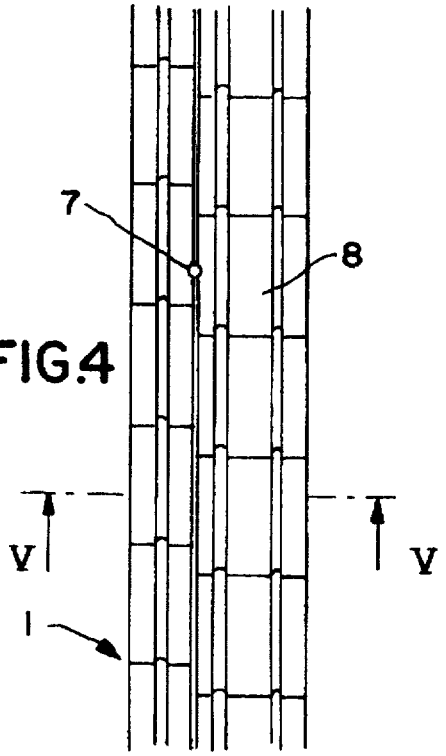
FIG. 4 is a section corresponding to FIG. 2, illustrating the brick-work of the regenerator separating wall of a top-heated composite coke oven.

FIGS. 2–5 show, in sectional form, the assembly of regenerator separating walls 1 in which the sealing of the separation walls takes place by means of gas-tight foils 7 that are arranged in the vertical joints behind the rectangtdar bricks 8. As for as the gas-tight foils are concerned, use can be made in this regard of foils that comprise, e.g., metal. FIGS. 2 and 3 relate in this regard to the regenerator wall of a base burner/composite coke oven, whereby FIG. 2 shows a horizontal section and FIG. 3 shows a vertical section along the dashed and dotted line in FIG. 2. The corresponding illustrations in FIG. 4 and FIG. 5 show the assembly of the regenerator wall 1 in the case of a top-heated composite coke oven. The vertical ducts 5 for rich gas are inapplicable here. Instead of these, horizontal ducts are provided in this case but these cannot be seen in FIG. 4 and FIG. 5.

FIGS. 6–9 show, in sectional form, the assembly of regenerator separating walls 1 in which, in addition to slot and key joints, additional grooves have been provided in the thrust joints in the molded bricks that are used for the assembly of the wall, so that molded bricks that thrust against one another communally form circular ducts 9 at the vertical surfaces. A sealing composition can be introduced or, as the case may be, compressed into these ducts 9 on erecting the brick-work for the regenerator separating walls 1. By means of these steps, one can also prevent the situation in which gas penetrates or, as the case may be, exits through possibly open thrust joints on the gas side. Fire-resistant compositions can be used as the sealing materials.

Figure 7:
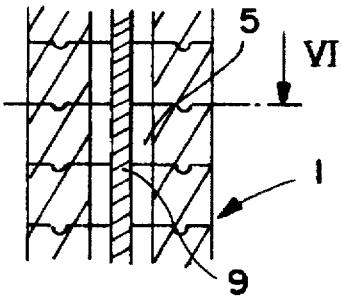
FIG. 7 is a vertical section along the line VII—VII of FIG. 6.
Figure 9:
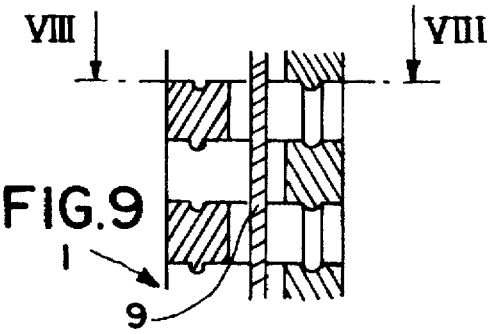
Figure 6:
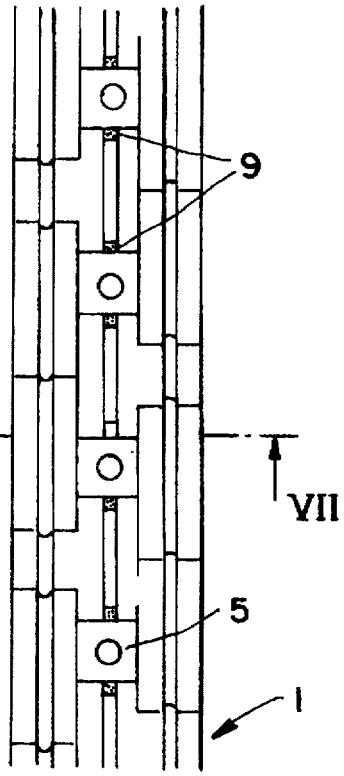
FIG. 6 is a horizontal section through a portion of a regenerator separating wall of a base burner/composite coke oven, whereby the sealing of the chambers takes place by means of vertical ducts that are arranged in the brick-work and whereby the ducts are filled with a sealing composition.
Figure 8:
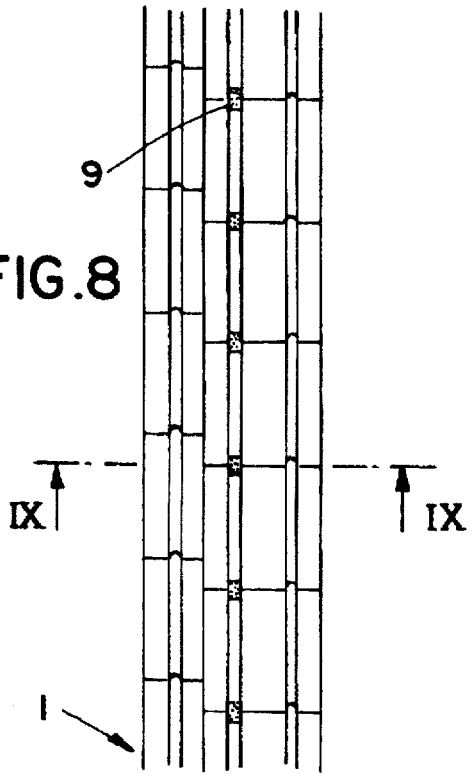
FIG. 8 is a section corresponding to FIG. 6, illustrating the brick-work of the regenerator separating wall of a top-heated composite coke oven; and, FIG. 9 is a vertical section along line IX—IX of FIG. 8.

FIGS. 6 and 7 in this regard again relate to the regenerator separating wall 1 of a base burner/composite coke oven, whereby FIG. 6 shows a horizontal section and FIG. 7 shows a vertical section along the dashed and dotted line in FIG. 6. The corresponding illustrations in FIG. 8 and FIG. 9 show the assembly of the regenerator separating wall 1 in the case of a top-heated composite coke oven. In regard to the diffrences between the two types of ovens, reference is again made to the above statements in relation to FIG. 2 through FIG. 5.

In summary, there is provided a process for reducing the concentration of CO in the waste gas of coke oven batteries that are heated with lean gas, characterized by the feature that additional sealing is used for the brick-work of the regenerator separating walls of the coke oven battery. Preferably, the separating walls include sheeting comprising a heat-resistant material that is installed in front of the gas-side surfaces of the regenerator separating walls. Preferably, there is provided an intermediate layer between the sheeting and the regenerator separating wall. The sheeting preferably comprises a compressible temperature-resistant material. Preferably, the additional sealing of the brick work takes place within the brick-work of the regenerator separating walls. Alternatively, the additional sealing takes place both with sheeting in front of the gas-side surfaces of the regenerator walls and within the brick-work of the regenerator separating walls. The oven battery is preferably heated with at least lean gas and includes a regenerator having brick-built separating walls between ducts that carry lean gas and waste gas. The front of the regenerator separating wall preferably has arranged stainless steel sheets. Preferably, there is an intermediate layer that is located behind the sheets and comprises ceramic fibers. The stainless steel sheets preferably alternate with one another and are preferably held together by rod-shaped tensioning devices. The stainless steel sheets and an intermediate layer are also preferably attached at the regenerator separating wall by means of gluing. The brick-built separating walls preferably include vertical joints behind the rectangular bricks of the brick-work of the regenerator separating walls. Preferably, at least one vertical joint includes arranged gas-tight foils. Furthermore, the vertical ducts in the brick-work preferably are filled with a sealing composition.

Naturally, the steps described above can also be used in combination with one another, if required, in order to seal off the regenerator separating walls.

The invention has been described with reference to a preferred embodiment and alternates thereof. It is believed that many modifications and alterations to the embodiment disclosed will readily suggest themselves to those skilled in the art upon reading and understanding the detailed description of the invention. It is intended to include all such modifications and alterations insofar as they come within the scope of the present invention.

We claim:

1. A coke oven for heating comprising a coke oven chamber, a gas conduit, a chamber wall positioned between said coke oven chamber and said gas conduit, and a sealing arrangement to substantially prevent gasses from flowing between said coke oven chamber and said gas conduit, said chamber wall having an oven face, said seal arrangement including a heat resistant sheet system secured to said oven face and including overlapping metal sheets and a sealing barrier positioned between said metal sheets and said gas conduit, said sealing barrier including a barrier selected from the group consisting of a gas-tight foil system positioned between said oven face and said gas conduit, a sealing composition positioned between said oven face and said gas conduit wall and combinations thereof.

2. A coke oven as defined in claim 1, wherein said heat resistant sheet system includes a sealing material positioned between said metal sheets and said oven face.

3. A coke oven as defined in claim 2, wherein said sealing material includes a material selected from the group consisting of ceramic fibers or fire resistant compressed compositions.

4. A coke oven as defined in claim 3, including a securing arrangement to secure said heat resistant sheet system to said oven face, said securing arrangement including an arrangement selected from the group consisting of tension devices pressing said heat resistant sheet system to said oven face, an adhesive securing said sealing material to said oven face and said metal sheets to said sealing material and combinations thereof.

5. A coke oven as defined in claim 4, wherein said chamber wall includes a brick wall comprising at least one layer of brick, said foil system includes a metal foil positioned between said at least one layer of brick and said gas conduit.

6. A coke oven as defined in claim 5, wherein said chamber wall includes at least one verticle duct, said sealing composition being a fire resistant composition and positioned in said at least one verticle duct.

7. A coke oven as defined in claim 6, wherein said chamber wall includes a brick wall, said brick wall comprising molded bricks having slot and key joints.

8. A coke oven as defined in claim 1, including a securing arrangement to secure said heat resistant sheet system to said oven face, said securing arrangement including an arrangement selected from the group consisting of tension devices pressing said heat resistant sheet system to said oven face, an adhesive securing said sealing material to said oven face and said metal sheets to said sealing material and combinations thereof.

9. A coke oven as defined in claim 1, wherein said chamber wall includes a brick wall comprising at least one layer of brick, said foil system includes a metal foil positioned between said at least one layer of brick and said gas conduit.

10. A coke oven as defined in claim 9, wherein said chamber wall includes at least one verticle duct, said sealing composition being a fire resistant composition and positioned in said at least one verticle duct.

11. A coke oven as defined in claim 9, wherein said chamber wall includes a brick wall, said brick wall comprising molded bricks having slot and key joints.

12. A coke oven as defined in claim 1, wherein said chamber wall includes a brick wall comprising at least one layer of brick, said foil system includes a metal foil positioned between said at least one layer of brick and said gas conduit.

13. A coke oven as defined in claim 1, wherein said chamber wall includes at least one verticle duct, said sealing composition being a fire resistant composition and positioned in said at least one verticle duct.

14. A coke oven as defined in claim 13, wherein said chamber wall includes a brick wall, said brick wall comprising molded bricks having slot and key joints.

15. A coke oven as defined in claim 1, wherein said chamber wall includes at least one verticle duct, said sealing composition being a fire resistant composition and positioned in said at least one verticle duct.

16. A coke oven as defined in claim 1, wherein said chamber wall includes a brick wall, said brick wall comprising molded bricks having slot and key joints.

17. A coke oven as defined in claim 1, wherein said chamber wall includes a brick wall, said brick wall comprising molded bricks having slot and key joints.

18. A coke oven for heating comprising a coke oven chamber, a gas conduit, a chamber wall positioned between said coke oven chamber and said gas conduit, and a sealing arrangement to prevent gasses from flowing between said coke oven chamber and said gas conduit, said chamber wall having an oven face, said sealing arrangement including a heat resistant sheet system secured to said oven face, said sheet system including overlapping metal sheets and a sealing material positioned between said metal sheets and said oven face.

19. A coke oven as defined in claim 18, wherein said sealing material being a mat which includes a material selected from the group consisting of ceramic fibers or fire resistant compressed compositions.

20. A coke oven as defined in claim 18, including a securing arrangement to secure said heat resistant sheet system to said oven face, said securing arrangement including an arrangement selected from the group consisting of tension devices pressing said heat resistant sheet system to said oven face, an adhesive securing said sealing material to said oven face and said metal sheets to said sealing material and combinations thereof.

21. A coke oven as defined in claim 18, wherein said chamber wall includes a brick wall comprising at least one layer of brick and a gas-tight foil system, said foil system includes a metal foil positioned between said at least one layer of brick and said gas conduit.

22. A coke oven as defined in claim 20, wherein said chamber wall includes a brick wall comprising at least one layer of brick and a gas-tight foil system, said foil system includes a metal foil positioned between said at least one layer of brick and said gas conduit.

23. A coke oven as defined in claim 22, wherein said chamber wall includes at least one verticle duct and a sealing composition, said sealing composition a fire resistant composition and positioned in said at least one verticle duct.

24. A coke oven as defined in claim 18, wherein said chamber wall includes at least one verticle duct and a sealing composition, said sealing composition being a fire resistant composition and positioned in said at least one verticle duct.

25. A coke oven as defined in claim 18, wherein said chamber wall includes a brick wall, said brick wall comprising molded bricks having slot and key joints.

* * * * *

UNITED STATES PATENT AND TRADEMARK OFFICE

CERTIFICATE OF CORRECTION

PATENT NO. : 5,705,037

DATED : January 6, 1998

INVENTOR(S) : Martin Reinke, Werner Hippe, Gunter Meyer, Hans Oldengott

It is certified that error appears in the above-identified patent and that said Letters Patent is hereby corrected as shown below:

Title page,

Item [73], change "Assignee: Krup Koppers GmbH, Germany" to --Assignee: Krupp Koppers GmbH, Germany--.

Signed and Sealed this

Twenty-fourth Day of August, 1999

*Attest:*

Q. TODD DICKINSON

*Attesting Officer*

*Acting Commissioner of Patents and Trademarks*